US011814605B2

(12) United States Patent
Da Silva et al.

(10) Patent No.: US 11,814,605 B2
(45) Date of Patent: Nov. 14, 2023

(54) SURFACTANT SYSTEMS

(71) Applicant: Conopco Inc., Englewood Cliffs, NJ (US)

(72) Inventors: Hélder Daniel Peixoto Da Silva, Sharnbrook (GB); Andrew Philip Parker, Wirral (GB); Craig Warren Jones, Wirral (GB); Anthony Mckee, Wirral (GB)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 17/605,007

(22) PCT Filed: Apr. 20, 2020

(86) PCT No.: PCT/EP2020/060973
§ 371 (c)(1),
(2) Date: Oct. 20, 2021

(87) PCT Pub. No.: WO2020/216705
PCT Pub. Date: Oct. 29, 2020

(65) Prior Publication Data

US 2022/0195335 A1 Jun. 23, 2022

(30) Foreign Application Priority Data

Apr. 23, 2019 (EP) ..... 19170472

(51) Int. Cl.

| | |
|---|---|
| ***C11D 1/831*** | (2006.01) |
| ***C11D 3/22*** | (2006.01) |
| ***C11D 1/66*** | (2006.01) |
| *C11D 3/50* | (2006.01) |

(52) U.S. Cl.
CPC ..... *C11D 1/831* (2013.01); *C11D 1/667* (2013.01); *C11D 3/50* (2013.01)

(58) Field of Classification Search
CPC ..... C11D 1/662; C11D 1/667; C11D 1/831; C11D 3/22; C11D 3/226; C11D 3/228
See application file for complete search history.

(56) References Cited

U.S. PATENT DOCUMENTS

2007/0259797 A1 11/2007 Fevola

FOREIGN PATENT DOCUMENTS

| | | | | |
|---|---|---|---|---|
| EP | 0832965 A1 | | 4/1998 | |
| KR | 2018-0114717 | * | 10/2018 | ..... C11D 1/83 |
| KR | 20180114717 | | 10/2018 | |
| WO | WO2011055327 A2 | | 5/2011 | |

* cited by examiner

*Primary Examiner* — Brian P Mruk
(74) *Attorney, Agent, or Firm* — N.V. Nederlandsch Octrooibureau

(57) ABSTRACT

The invention provides a surfactant system, for use in household detergent compositions, which is a mixture of:

(i) at least one sulfonate-functionalized alkyl polyglycoside of general formula (I):

$$R—O-(G)_n-(D) \quad (I)$$

in which:
R represents a straight or branched chain monovalent hydrocarbyl radical having from 6 to 22 carbon atoms; G represents a residue of a reducing saccharide, connected to R—O by means of an ethereal O-glycosidic bond; n represents a number from 1 to 10; and D represents a $—CH_2CH(OH)CH_2—SO_3M$ group connected to an oxygen atom of G, where M is selected from H or a monovalent cation selected from Na, K, or $NH_4$;
and (ii) at least one ethoxylated fatty acid sorbitan ester of general formula (II):

$$Sorb-(EO_{n1}R_1)(EO_{n2}R_2)(EO_{n3}R_3)(EO_{n4}R_4) \quad (II)$$

in which:
Sorb represents a residue obtained by removing four hydroxyl H atoms from sorbitan; EO represents an ethyleneoxy group; $R_1$, $R_2$, $R_3$ and $R_4$ are each independently selected from H or a $—C(O)R_5$ group in which $R_5$ is selected from straight or branched chain monovalent hydrocarbyl radicals having from 8 to 22 carbon atoms and mixtures thereof (provided that at least one of $R_1$ to $R_4$ is $—C(O)R_5$); $n_1$, $n_2$, $n_3$ and $n_4$ each independently represent average values from 0 to 10; and the total $[n_1+n_2+n_3+n_4]$ has an average value from 4 to 30;
and in which the weight ratio of (i):(ii) in the mixture ranges from 5:1 to 1:5.

8 Claims, No Drawings

SURFACTANT SYSTEMS

The present invention relates to surfactant systems and their applications.

Anionic sulfonate or sulfate surfactants, for example linear alkylbenzene sulfonate (LAS) or primary alcohol sulfate (PAS), are often used as the principal detergent-active ingredients in household detergent compositions because of their excellent cleaning properties. They are frequently used in conjunction with ethoxylated alcohol nonionic surfactants which give improved detergency on hydrophobic soils.

The above anionic and anionic/nonionic surfactant systems are robust and highly efficient on a wide range of soils and under a wide range of conditions, for example, temperature and water hardness. However, the anionic surfactants are not noted for mildness to skin.

The problem underlying the present invention is to provide surfactant systems, for use in household detergent compositions, which are benign to the skin yet can offer a performance that is comparable to that of "traditional" anionic and anionic/nonionic surfactant systems, especially on difficult-to-remove stains. Such stains include, for example, polyphenolic-based stains such as cherry juice, blueberry juice and red wine, along with tea, coffee and chocolate pudding. Other problematic stains include particulate soils such as mud, clay and soot.

This problem is solved by providing the surfactant system according to the present invention.

Accordingly, in one aspect the invention provides, a surfactant system, for use in household detergent compositions, which is a mixture of (i) at least one sulphonate-functionalised alkyl polyglycoside and (ii) at least one ethoxylated fatty acid sorbitan ester with an average ethoxylation from 4-30, preferably from 15-25.

Preferably the at least one sulphonate-functionalised alkyl polyglycoside has a general formula (I):

$$R—O-(G)_n-(D) \quad (I)$$

in which:

R represents a straight or branched chain monovalent hydrocarbyl radical having from 6 to 22 carbon atoms; G represents a residue of a reducing saccharide, connected to R—O by means of an ethereal O-glycosidic bond; n represents a number from 1 to 10; and D represents a $—CH_2CH(OH)CH_2—SO_3M$ group connected to an oxygen atom of G, where M is selected from H or a monovalent cation selected from Na, K, or $NH_4$.

Preferably the at least one ethoxylated fatty acid sorbitan ester has general formula (II):

$$Sorb-(EO_{n1}R_1)(EO_{n2}R_2)(EO_{n3}R_3)(EO_{n4}R_4) \quad (II)$$

in which:

Sorb represents a residue obtained by removing four hydroxyl H atoms from sorbitan; EO represents an ethyleneoxy group; $R_1$, $R_2$, $R_3$ and $R_4$ are each independently selected from H or a $—C(O)R_5$ group in which $R_5$ is selected from straight or branched chain monovalent hydrocarbyl radicals having from 8 to 22 carbon atoms and mixtures thereof (provided that at least one of $R_1$ to $R_4$ is $—C(O)R_5$); $n_1$, $n_2$, $n_3$ and $n_4$ each independently represent average values from 0 to 10; and the total $[n_1+n_2+n_3+n_4]$ has an average value from 4-30, preferably from 15-25.

Preferably, the weight ratio of (i):(ii) in the mixture ranges from 5:1 to 1:5.

In another aspect the invention provides surfactant system, for use in household detergent compositions, which is a mixture of:

(i) at least one sulfonate-functionalized alkyl polyglycoside of general formula (I):

$$R—O-(G)_n-(D) \quad (I)$$

in which:

R represents a straight or branched chain monovalent hydrocarbyl radical having from 6 to 22 carbon atoms; G represents a residue of a reducing saccharide, connected to R—O by means of an ethereal O-glycosidic bond; n represents a number from 1 to 10; and D represents a $—CH_2CH(OH)CH_2—SO_3M$ group connected to an oxygen atom of G, where M is selected from H or a monovalent cation selected from Na, K, or $NH_4$;

and (ii) at least one ethoxylated fatty acid sorbitan ester of general formula (II):

$$Sorb-(EO_{n1}R_1)(EO_{n2}R_2)(EO_{n3}R_3)(EO_{n4}R_4) \quad (II)$$

in which:

Sorb represents a residue obtained by removing four hydroxyl H atoms from sorbitan; EO represents an ethyleneoxy group; $R_1$, $R_2$, $R_3$ and $R_4$ are each independently selected from H or a $—C(O)R_5$ group in which $R_5$ is selected from straight or branched chain monovalent hydrocarbyl radicals having from 8 to 22 carbon atoms and mixtures thereof (provided that at least one of $R_1$ to $R_4$ is $—C(O)R_5$); $n_1$, $n_2$, $n_3$ and $n_4$ each independently represent average values from 0 to 10; and the total $[n_1+n_2+n_3+n_4]$ has an average value from 4 to 30 preferably from 5-25;

and preferably the weight ratio of (i):(ii) in the mixture ranges from 5:1 to 1:5.

In formula (I) above, the term "reducing saccharide" denotes a saccharide that can be alkylated in the "1" position. These saccharides are typically aldo- or keto-hexoses or pentoses. Preferred reducing saccharides are glucose, galactose, xylose and arabinose, or mixtures thereof, with glucose being most preferred.

R in formula (I) is preferably selected from linear or branched, alkyl or alkenyl groups having from 8 to 18 carbon atoms and 0 or 1 double bond. More preferably, R in formula (I) is selected from linear alkyl groups containing from 8 to 16 carbon atoms such as decyl, lauryl, myristyl and cetyl and mixtures thereof. Most preferably, R in formula (I) is selected from decyl, lauryl and mixtures thereof (as may for example be derived from natural fats and/or optionally hydrogenated natural oils such as coconut oil or palm kernel oil).

The value of n in formula (I) indicates the degree of polymerisation., i.e. the distribution of mono- and polyglycosides. Whereas n in a given compound will be an integer, alkyl polyglycosides are usually provided as mixtures where there are varying degrees of polymerisation. Thus, the value of n usually represents the average (mean) degree of polymerisation of the mixture, and so may be non-integral. Preferably n ranges from 1 to 3, more preferably from 1.1 to 2 and most preferably from 1.2 to 1.5.

In another aspect the invention provides a surfactant system for the treatment of a substrate comprising (i) a sugar-based anionic surfactant and (ii) an ethoxylated fatty acid sorbitan ester having an average exthoxylation from 4 to 30, preferably 15-25. The sugar-based anionic surfactant may be a sulphonate-functionalised akyl polyglycoside, such as with formula (I). The ethoxylated fatty acid sorbitan ester may have formula (II).

Preferably the substrate is any suitable substrate including clothing, linens and other household textiles etc., and dishes, where "dishes" is used herein in a generic sense, and encompasses essentially any items which may be found in a dishwashing load, including crockery chinaware, glassware, plasticware, hollowware and cutlery, including silverware. Examples of suitable sulfonate-functionalized alkyl polyglycosides (i) for use in the invention include sodium laurylglucosides hydroxypropyl sulfonate and sodium decylglucosides hydroxypropyl sulfonate and mixtures thereof.

Sorbitan is a generic name for anhydrides derived from sorbitol, a naturally occurring crystalline hexahydric alcohol found in fruits, seaweed, and algae. In formula (II) above, the residue 'Sorb' is obtained by removing four hydroxyl H atoms from sorbitan, and will typically be a mixture of residues of 1,4-anhydrosorbitol, 1,5-anhydrosorbitol, and 3,6-anhydrosorbitol. The ethoxylated fatty acid ester is formed by each of the removed H atoms being substituted with the groups $(EO_{n1}R_1)$, $(EO_{n2}R_2)$, $(EO_{n3}R_3)$, and $(EO_{n4}R_4)$. Preferably, one of $R_1$ to $R_4$ is —C(O)$R_5$ and the remaining 3 are hydrogen. However, esters with more than one —C(O)$R_5$ group (e.g. diesters and triesters) will also usually be present in the products as synthesised. Thus the products will often have non-integral ratios of Sorb and $R_5$ residues as defined in formula (II). For example, an average of 1.4 to 1.5 of the $R_1$, to $R_4$ groups may be —C(O)$R_5$ and the remaining 2.5 to 2.6 hydrogen.

The individual oligoethoxylate chain lengths corresponding to the individual indices $n_1$, $n_2$, $n_3$ and $n_4$ in formula (II) are preferably each within the range from 0.5 to 6 and more preferably from 1 to 5. As the indices represent average values for the oligoethoxylate chain lengths, they may individually and in total be non-integral. The total $[n_1+n_2+n_3+n_4]$ in formula (II) preferably has an average value (an "average ethoxylation value" as used herein, from 15 to 25, more preferably from 18 to 22 and most preferably 20. Higher ethoxylation values can reduce cleaning efficiency due to increased hydrophilicity and lower ethoxylation values reduce cleaning efficiency as the molecule becomes less soluble.

$R_5$ in formula (II) is preferably selected from linear or branched, alkyl or alkenyl groups having from 10 to 20 carbon atoms and 0 or 1 double bond. More preferably, $R_5$ in formula (II) is selected from linear alkyl or linear alkenyl groups containing from 12 to 18 carbon atoms and 0 or 1 double bond, such as lauryl, myristyl, palmityl, cetyl, oleyl and stearyl and mixtures thereof. Most preferably, $R_5$ in formula (II) is selected from oleyl, stearyl and lauryl and mixtures thereof (as may for example be derived from natural fats and/or optionally hydrogenated natural oils such as palm oil, soybean oil, rapeseed oil, sunflower oil and tallow).

Examples of suitable ethoxylated fatty acid sorbitan esters (ii) for use in the invention include polyoxyethylene (20) sorbitan monolaurate, polyoxyethylene (20) sorbitan monopalmitate, polyoxyethylene (20) sorbitan monostearate, polyoxyethylene (20) sorbitan monooleate and mixtures thereof.

In a preferred surfactant system according to the present invention, the sulfonate-functionalized alkyl polyglycosides (i) are selected from sodium laurylglucosides hydroxypropyl sulfonate and sodium decylglucosides hydroxypropyl sulfonate and mixtures thereof; the ethoxylated fatty acid sorbitan esters (ii) are selected from polyoxyethylene (20) sorbitan monolaurate, polyoxyethylene (20) sorbitan monopalmitate, polyoxyethylene (20) sorbitan monostearate, polyoxyethylene (20) sorbitan monooleate and mixtures thereof; and the weight ratio of (i) to (ii) in the mixture ranges from 4:1 to 1:2.

The surfactant system of the invention is useful in a variety of end use applications including general purpose detergency, including laundry and hard surface cleaner applications.

The invention accordingly includes detergent compositions including the surfactant system of the invention and methods of cleaning using detergent compositions including the surfactant system of the invention.

In laundry applications, the surfactant system of the invention will typically be formulated together with other ingredients into a laundry detergent composition.

The invention accordingly includes laundry detergent compositions including the surfactant system of the invention and methods of cleaning laundry using laundry detergent compositions including the surfactant system of the invention.

The term "laundry detergent composition" in the context of this invention denotes formulated compositions intended for and capable of wetting and cleaning domestic laundry such as clothing, linens and other household textiles. The term "linen" is often used to describe certain types of laundry items including bed sheets, pillow cases, towels, tablecloths, table napkins and uniforms. The term "textiles" can include woven fabrics, non-woven fabrics, and knitted fabrics; and can include natural or synthetic fibres such as silk fibres, linen fibres, cotton fibres, polyester fibres, polyamide fibres such as nylon, acrylic fibres, acetate fibres, and blends thereof including cotton and polyester blends.

Examples of laundry detergent compositions include heavy-duty detergents for use in the wash cycle of automatic washing machines, as well as fine wash and colour care detergents such as those suitable for washing delicate garments (e.g. those made of silk or wool) either by hand or in the wash cycle of automatic washing machines.

A laundry detergent composition according to the invention may suitably be in liquid or particulate form, or a mixture thereof.

The term "particulate" in the context of this invention denotes free-flowing or compacted solid forms such as powders, granules, pellets, flakes, bars, briquettes or tablets.

One preferred form for a particulate laundry detergent composition according to the invention is a free-flowing powdered solid, with a loose (unpackaged) bulk density generally ranging from about 200 g/l to about 1,300 g/l, preferably from about 400 g/l to about 1,000 g/l, more preferably from about 500 g/l to about 900 g/l.

The laundry detergent composition according to the invention is most preferably in liquid form.

The term "liquid" in the context of this invention denotes that a continuous phase or predominant part of the composition is liquid and that the composition is flowable at 15° C. and above. Accordingly, the term "liquid" may encompass emulsions, suspensions, and compositions having flowable yet stiffer consistency, known as gels or pastes. The viscosity of the composition may suitably range from about 200 to about 10,000 mPa·s at 25° C. at a shear rate of 21 $sec^{-1}$. This shear rate is the shear rate that is usually exerted on the liquid when poured from a bottle. Pourable liquid compositions generally have a viscosity of from 200 to 2,500 mPa·s, preferably from 200 to 1500 mPa·s. Liquid compositions which are pourable gels generally have a viscosity of from 1,500 mPa·s to 6,000 mPa·s, preferably from 1,500 mPa·s to 2,000 mPa·s.

In a laundry detergent composition according to the invention, the level of sulfonate-functionalized alkyl polyglycoside (i) suitably ranges from 3 to 40% (by weight based on the total weight of the composition); the level of ethoxylated fatty acid sorbitan ester (ii) suitably ranges from 1 to 40% (by weight based on the total weight of the composition)

The total combined level of sulfonate-functionalized alkyl polyglycoside (i) and ethoxylated fatty acid sorbitan ester (ii) in a laundry detergent composition according to the invention suitably ranges from 10 to 90% preferably 10 to 55% and more preferably ranges from 15 to 25% (by weight based on the total weight of the composition).

A laundry detergent composition according to the invention may also include further surfactants (in addition to the surfactant system of the invention as defined above).

Examples of further surfactants (in addition to the surfactant system of the invention) include:

(a) anionic alkyl sulfates or sulfonates selected from salts of $C_{8-22}$ alkylaryl sulfonates, $C_{8-22}$ alkyl sulfates and $C_{8-22}$ alkyl ether sulfates. Examples of such materials include salts of linear alkylbenzene sulfonates (LAS) with a linear alkyl chain length of from 10 to 16 carbon atoms; salts of alkyl ether sulfates having an alkyl chain length of from 10 to 16 carbon atoms and containing an average of 1 to 3EO units per molecule, and salts of non-ethoxylated alkyl sulfates with an alkyl chain length of from 10 to 18. The salt-forming counterion is generally an alkali metal such as sodium or potassium; or an ammoniacal counterion such as monoethanolamine, (MEA) diethanolamine (DEA) or triethanolamine (TEA). Mixtures of any of the above described materials may also be used.

(b) nonionic aliphatic alcohol ethoxylates selected from aliphatic $C_8$ to $C_{18}$, more preferably $C_{12}$ to $C_{15}$, primary linear alcohol ethoxylates with an average of from 3 to 20, more preferably from 5 to 10 moles of ethylene oxide per mole of alcohol. Mixtures of any of the above described materials may also be used.

However, it may be preferable in some cases that the level of such further surfactants (a) and/or (b) is no more than 0.1%, more preferably from 0 to 0.01% and most preferably 0% (by weight based on the total weight of the composition).

A liquid laundry detergent composition according to the invention may generally comprise from 5 to 95%, preferably from 10 to 90%, more preferably from 15 to 85% water (by weight based on the total weight of the composition). The composition may also incorporate from 0.1 to 15% (by weight based on the total weight of the composition) of non-aqueous carriers such as hydrotropes, co-solvents and phase stabilizers.

A laundry detergent composition according to the invention may suitably include one or more organic builders and/or sequestrants. Organic builders and/or sequestrants may help to enhance or maintain the cleaning efficiency of the composition, primarily by coordinating (i.e. binding) those metal ions which might otherwise interfere with cleaning action. Examples of such metal ions which are commonly found in wash water include divalent and trivalent metal ions such as ferrous, ferric, manganese, copper magnesium and calcium ions.

Suitable organic builders and/or sequestrants for use in the invention include polycarboxylates, in acid and/or salt form. When utilized in salt form, alkali metal (e.g. sodium and potassium) or alkanolammonium salts are preferred. Specific examples of such materials include sodium and potassium citrates, sodium and potassium tartrates, the sodium and potassium salts of tartaric acid monosuccinate, the sodium and potassium salts of tartaric acid disuccinate, sodium and potassium ethylenediamine tetraacetates, sodium and potassium N(2-hydroxyethyl)-ethylenediamine triacetates, sodium and potassium nitrilotriacetates and sodium and potassium N-(2-hydroxyethyl)-nitrilodiacetates. Polymeric polycarboxylates may also be used, such as polymers of unsaturated monocarboxylic acids (e.g. acrylic, methacrylic, vinylacetic, and crotonic acids) and/or unsaturated dicarboxylic acids (e.g. maleic, fumaric, itaconic, mesaconic and citraconic acids and their anhydrides). Specific examples of such materials include polyacrylic acid, polymaleic acid, and copolymers of acrylic and maleic acid. The polymers may be in acid, salt or partially neutralised form and may suitably have a molecular weight (Mw) ranging from about 1,000 to 100,000, preferably from about 2,000 to about 85,000, and more preferably from about 2,500 to about 75,000. A preferred polycarboxylate sequestrant for use in the invention is citrate (in acid and/or salt form). Most preferred is sodium citrate.

Organic builders and/or sequestrants, when included, may be present in an amount ranging from 0.1 to about 15%, more preferably from 1 to 10% and most preferably from 2 to 5% (by weight based on the total weight of the composition).

A particulate laundry detergent composition of the invention may include one or more fillers to assist in providing the desired density and bulk to the composition. Preferred fillers for use in the invention include alkali metal (more preferably sodium and/or potassium) sulfates and chlorides and mixtures thereof, with sodium sulfate and/or sodium chloride being most preferred. Filler, when included, may be present in a total amount ranging from about 1 to about 80%, preferably from about 5 to about 50% (by weight based on the total weight of the composition).

A laundry detergent composition according to the invention may include one or more polymeric cleaning boosters such as antiredeposition polymers, soil release polymers and mixtures thereof.

Anti-redeposition polymers stabilise the soil in the wash solution thus preventing redeposition of the soil. A preferred material is ethoxylated polyethyleneimine, with an average degree of ethoxylation being from 10 to 30, preferably from 15 to 25 ethoxy groups per ethoxylated nitrogen atom in the polyethyleneimine backbone. Another type of suitable anti-redeposition polymer for use in the invention includes cellulose esters and ethers, for example sodium carboxymethyl cellulose.

Mixtures of any of the above described materials may also be used.

The overall level of anti-redeposition polymer, when included, may range from 0.05 to 6%, more preferably from 0.1 to 5% (by weight based on the total weight of the composition).

Soil release polymers (SRPs) help to improve the detachment of soils from fabric by modifying the fabric surface during washing. The adsorption of a SRP over the fabric surface is promoted by an affinity between the chemical structure of the SRP and the target fibre. Preferred SRPs for use in the invention include copolyesters formed by condensation of terephthalic acid ester and diol, preferably 1,2 propanediol, and further comprising an end cap formed from repeat units of alkylene oxide capped with an alkyl group.

Mixtures of any of the above described materials may also be used.

The overall level of SRP, when included, may range from 0.1 to 10%, preferably from 0.3 to 7%, more preferably from 0.5 to 5% (by weight based on the total weight of the composition).

A liquid laundry detergent composition according to the invention may comprise one or more rheology modifiers such as polymeric thickeners, such as hydrophobically modified alkali swellable emulsion (HASE) copolymers; and/or structurants which form a network within the composition, such as hydrogenated castor oil, microfibrous cellulose and citrus pulp fibre, gums, A laundry detergent composition according to the invention may comprise an effective amount of one or more enzymes selected from the group comprising, pectate lyase, protease, amylase, cellulase, lipase, mannanase and mixtures thereof. The enzymes are preferably present with corresponding enzyme stabilizers.

A liquid laundry detergent composition according to the invention preferably has a pH in the range of 5 to 9, more preferably 6 to 8, when measured on dilution of the composition to 1% (by weight based on the total weight of the composition) using demineralised water.

A laundry detergent composition of the invention may contain further optional ingredients to enhance performance and/or consumer acceptability. Examples of such ingredients include fragrance oils, foam boosting agents, preservatives (e.g. bactericides), antioxidants, sunscreens, anticorrosion agents, colorants, pearlisers and/or opacifiers, and shading dye. Each of these ingredients will be present in an amount effective to accomplish its purpose. Generally, these optional ingredients are included individually at an amount of up to 5% (by weight based on the total weight of the composition).

Packaging and Dosing

A laundry detergent composition of the invention may be packaged as unit doses in polymeric film soluble in the wash water. Alternatively, the detergent composition of the invention may be supplied in multidose plastics packs with a top or bottom closure. A dosing measure may be supplied with the pack either as a part of the cap or as an integrated system.

A method for the laundering of fabric stains using a laundry detergent composition according to the invention comprises diluting a dose of the laundry detergent composition to obtain a wash liquor, and washing the stained fabric with the wash liquor so formed.

The method may suitably be carried out in a top-loading or front-loading automatic washing machine, or can be carried out by hand.

In automatic washing machines, the dose of laundry detergent composition is typically put into a dispenser and from there it is flushed into the machine by the water flowing into the 5 machine, thereby forming the wash liquor. Dosages for a typical front-loading washing machine (using 10 to 15 litres of water to form the wash liquor) may range from about 10 ml to about 100 ml, preferably about 15 to 75 ml. Dosages for a typical top-loading washing machine (using from 40 to 60 litres of water to form the wash liquor) may be higher, e.g. 100 ml or more. Lower dosages of detergent (e.g. 50 ml or less) may be 10 used for hand washing methods (using about 1 to 10 litres of water to form the wash liquor).

A subsequent aqueous rinse step and drying the laundry is preferred. Any input of water during any optional rinsing step(s) is not included when determining the volume of the wash liquor. Laundry drying can take place either in an automatic dryer or in the open air.

The invention will now be further described with reference to the following non-limiting Examples.

EXAMPLES

All weight percentages are by weight based on total weight unless otherwise specified.

A series of surfactant mixtures were prepared with ingredients and ratios as shown below in Table 1:

TABLE 1

| Ingredient | wt. % (active ingredient) | | |
|---|---|---|---|
| Formulation | Ex. 1 | Ex. 2 | Ex. 3 |
| polyoxyethylene (20) sorbitan monolaurate | 6.9 | 11.5 | 3 |
| sodium decylglucosides hydroxypropylsulfonate (1) | 8.1 | 13.5 | 12 |
| sodium citrate | 4 | 4 | 4 |
| EPEI(2) | 3 | 3 | 3 |
| SRP | 1 | 1 | 1 |
| Demineralised water | q.s. to 100 | | |

(1) Suga ®Nate 100NC, ex Colonial Chemicals
(2)Sokalan ®HP20, ex BASF

Polyester test fabrics and cotton test fabrics stained with a range of standard stains were washed with a 2.3 g/L aqueous solution of each of Examples 1,2 and 3 according to the invention. A commercially available formulation (UK Persil™ Non-Bio liquid laundry detergent) at the same level of dilution was used as a control (not according to the invention).

The extent of stain removal was measured by making diffuse reflectance measurements using a spectrometer, and expressed as the Stain Removal Index (SRI), defined as:

SRI=100−ΔE, where ΔE is the difference in colour of the stained test fabric compared to the unstained test fabric.

A higher SRI value indicates cleaner fabric. The results are shown in Table 2.

TABLE 2

| | Test formulation | | | |
|---|---|---|---|---|
| | 1 | 2 | 3 | Control |
| Test stain/fabric | Stain removal index (SRI) | | | |
| red soil/polyester | 77.4 | 76.6 | 75.6 | 75.2 |
| red wine/cotton | 84.7 | 85.9 | 85.2 | 86.4 |
| cooked beef fat/polyester | 85.8 | 86.8 | 86.6 | 89.6 |

The results show that Examples 1,2 and 3 according to the invention provide parity performance against most of the standard stains when compared with the control.

A further series of surfactant mixtures were prepared with ingredients and ratios as shown below in Table 3:

TABLE 3

| Ingredient | wt. % (active ingredient) | | | | | |
|---|---|---|---|---|---|---|
| Formulation | A | B | C | D | 4 | 5 |
| $C_{12-14}$ LAS | 5.8 | 3.3 | 12.1 | 16 | | |
| SLES (3EO) | 4.4 | 10 | | | | |
| $C_{12-15}$ alcohol ethoxylate (7EO) | 4.4 | 0.8 | 1.2 | | | |
| CAPB | | 1.9 | | | | |
| sodium laurylglucosides hydroxypropylsulfonate(3) | | | | | 10 | 5 |
| polyoxyethylene (20) sorbitan monopalmitate | | | | | 5 | 10 |
| water | | | q.s. to 100 | | | |

(3)Suga ®Nate 160NC, ex Colonial Chemicals

Examples 4 and 5 are examples according to the invention. Examples A,B,C and D are comparative examples (not according to the invention).

The formulations from Table 3 were tested in a Zein Assay. A low number indicates a milder formulation. The assay scores are shown below in Table 4.

TABLE 4

| Formulation | Absorbance at 590 nm for 20 g/L product |
|---|---|
| A | 0.782 |
| B | 1.697 |
| C | 0.987 |
| D | 1.549 |
| 4 | 0.299 |
| 5 | 0.122 |

The results show that Examples 4 and 5 according to the invention provide superior mildness when compared with Examples A to D (not according to the invention).

The invention claimed is:

1. A surfactant system, for use in household detergent compositions, which is a mixture of (i) at least one sulphonate-functionalised alkyl polyglycoside selected from sodium laurylglucosides hydroxypropyl sulfonate or sodium decylglucosides hydroxypropyl sulfonate and mixtures thereof and (ii) at least one ethoxylated fatty acid sorbitan ester with an average ethoxylation of 15-25.

2. The surfactant system according to claim 1 in which the weight ratio of (i):(ii) in the mixture ranges from 5:1 to 1:5.

3. The surfactant system according to claim 1, in which the sulphonate—functionalised alkyl polyglycosides (i) are selected from sodium laurylglucosides hydroxypropyl sulfonate and sodium decylglucosides hydroxypropyl sulfonate and mixtures thereof; the ethoxylated fatty acid sorbitan esters (ii) are selected from polyoxyethylene (20) sorbitan monolaurate, polyoxyethylene (20) sorbitan monopalmitate, polyoxyethylene (20) sorbitan monostearate, polyoxyethylene (20) sorbitan monooleate and mixtures thereof; and the weight ratio of (i) to (ii) in the mixture ranges from 4:1 to 1:2.

4. A laundry detergent composition including the surfactant system according to claim 1.

5. The laundry detergent composition according to claim 4, in which the total combined level of sulphonate—functionalised alkyl polyglycoside (i) and ethoxylated fatty acid sorbitan ester (ii) ranges from 10 to 90% by weight based on the total weight of the composition.

6. The laundry detergent composition according to claim 5, in which the level of sulphonate—functionalised alkyl polyglycoside (i) ranges from 3 to 40% by weight based on the total weight of the composition and the level of ethoxylated fatty acid sorbitan ester (ii) ranges from 1 to 35% by weight based on the total weight of the composition.

7. The laundry detergent composition according to claim 6, which further comprises from 1 to 10% by weight based on the total weight of the composition of organic builders and/or sequestrants selected from polycarboxylates, in acid and/or salt form.

8. The laundry detergent composition according to claim 7, in which the organic builder and/or sequestrant is sodium citrate.

* * * * *